US009570005B2

(12) United States Patent
Qing et al.

(10) Patent No.: US 9,570,005 B2
(45) Date of Patent: Feb. 14, 2017

(54) PIXEL CIRCUIT, DRIVING METHOD THEREFOR AND DISPLAY DEVICE

(71) Applicants: CHENGDU BOE OPTOELECTRONICS TECHNOLOGY CO., LTD., Chengdu, Sichuan (CN); BOE TECHNOLOGY GROUP CO., LTD., Beijing (CN)

(72) Inventors: Haigang Qing, Beijing (CN); Xiaojing Qi, Beijing (CN)

(73) Assignees: CHENGDU BOE OPTOELECTRONICS TECHNOLOGY CO., LTD., Chengdu, Sichuan Province (CN); BOE TECHNOLOGY GROUP CO., LTD., Beijing (CN)

( * ) Notice: Subject to any disclaimer, the term of this patent is extended or adjusted under 35 U.S.C. 154(b) by 398 days.

(21) Appl. No.: 14/235,961

(22) PCT Filed: Jun. 13, 2013

(86) PCT No.: PCT/CN2013/077166

§ 371 (c)(1),
(2) Date: Jan. 29, 2014

(87) PCT Pub. No.: WO2014/169512

PCT Pub. Date: Oct. 23, 2014

(65) Prior Publication Data

US 2014/0306867 A1 Oct. 16, 2014

(30) Foreign Application Priority Data

Apr. 15, 2013 (CN) ..... 2013 1 0129993

(51) Int. Cl.
*G09G 3/3233* (2016.01)
*G09G 3/32* (2016.01)

(52) U.S. Cl.
CPC .... *G09G 3/3233* (2013.01); *G09G 2300/0866* (2013.01); *G09G 2354/00* (2013.01)

(58) Field of Classification Search
CPC ..... G09G 3/3233; G09G 2300/0866; G09G 2354/00
See application file for complete search history.

(56) References Cited

U.S. PATENT DOCUMENTS

2005/0057454 A1* 3/2005 Jang ..... G09G 3/2022 345/76
2005/0156829 A1* 7/2005 Choi ..... G09G 3/3233 345/76

(Continued)

FOREIGN PATENT DOCUMENTS

CN 1623178 A 6/2005
CN 102469329 A 5/2012
CN 203242305 u 10/2013

OTHER PUBLICATIONS

International Search Report mailed Jan. 23, 2014; PCT/CN2013/077166.

(Continued)

*Primary Examiner* — Kumar Patel
*Assistant Examiner* — Sejoon Ahn
(74) *Attorney, Agent, or Firm* — Ladas & Parry LLP

(57) ABSTRACT

Provided are a pixel circuit, a driving method for the pixel circuit and a display device including the pixel circuit. In the pixel circuit, when the data is written to the storage capacitor, the threshold voltage of the driving transistor and the data voltage are pre-stored in the storage capacitor by means of a diode connection formed by the driving transistor, so that the drift of the threshold voltage can be compensated effectively, and thus the uniformity and the stability of the driving current are maintained. Further, in the embodiment of the present disclosure, the scan signal for the pixel circuit (Continued)

is multiplexed in the touch circuit, and the coupling capacitor in the touch circuit is charged simultaneously while the storage capacitor is charged, and thus, the integration of the touch circuit into the pixel circuit can be realized perfectly without increasing the complexity of the circuit structure and the operation thereof.

17 Claims, 8 Drawing Sheets

(56) References Cited

U.S. PATENT DOCUMENTS

2005/0285827 A1* 12/2005 Eom ..... G09G 3/3233 345/76
2006/0038758 A1* 2/2006 Routley ..... G09G 3/3233 345/81
2007/0040772 A1 2/2007 Kim
2008/0150846 A1* 6/2008 Chung ..... G09G 3/3233 345/80
2008/0231562 A1* 9/2008 Kwon ..... G09G 3/3233 345/77
2009/0284519 A1* 11/2009 Kim ..... G09G 3/3233 345/213
2011/0205250 A1* 8/2011 Yoo ..... G09G 3/3233 345/690
2012/0113161 A1* 5/2012 Hong ..... G09G 3/003 345/690

OTHER PUBLICATIONS

First Chinese Office Action dated Nov. 24, 2014; Appln. No. 201310129993.8.
International Preliminary Report on Patentability Appln. No. PCT/CN201/077166I; Dated Oct. 20, 2015.

* cited by examiner

PIXEL CIRCUIT, DRIVING METHOD THEREFOR AND DISPLAY DEVICE

TECHNICAL FIELD

The present disclosure relates to a field of organic light-emitting display technology, particularly to a pixel circuit, a driving method for the pixel circuit and a display device comprising the pixel circuit.

BACKGROUND

Compared to conventional liquid crystal panels, an Active Matrix Organic Light Emitting Diode (AMOLED) panel has characteristics such as a faster response speed, a higher contrast, and a wider view angle and the like. Thus, AMOLED has gained an increasing attention of developers of display devices.

The AMOLED is driven via a pixel circuit to emit light. A conventional 2T1C pixel circuit comprises two Thin Film Transistors (TFTs) and one capacitor (C), and is particularly illustrated in FIG. 1, the pixel circuit comprises a driving transistor DTFT, a switching transistor T5' and a storage capacitor $C_{st}$, wherein the switching transistor T5' is controlled by a scan signal $V_{scan}$ to control an input of a data voltage $V_{data}$, the driving transistor DTFT controls an OLED to emit light, and the storage capacitor $C_{st}$ supplies a maintaining voltage to a gate of the driving transistor DTFT.

FIG. 2 shows a driving timing diagram of the 2T1C pixel circuit illustrated in FIG. 1. The operational process of the 2T1C pixel circuit is as follows: when the scan signal is at a low level, the switching transistor T5' is turned on, and the storage capacitor $C_{st}$ is charged by a grayscale voltage (a data voltage $V_{data}$) on a data line; meanwhile, the data voltage $V_{data}$ is applied to the gate of the driving transistor DTFT, so that the driving transistor DTFT operates in a saturation state to drive the OLED to emit light; when the scan signal is at a high level, the switching transistor T5' is turned off, and the storage capacitor $C_{st}$ supplies the maintaining voltage to the gate of the driving transistor DTFT, so that the driving transistor DTFT still operates in a saturation state to drive the OLED to emit light continuously.

It can be known from the above, the OLED in the AMOLED panel can be driven to emit light by a driving current generated by the driving transistor DTFT in the saturation state. Specifically, the driving current (flowing through an circuit in which OLED is located) $I_{OLED}=K(V_{sg}-|V_{thd}|)^2$, wherein $V_{sg}$ represents a voltage difference between the gate and a source of the driving transistor DTFT, $|V_{thd}|$ represents a threshold voltage of the driving transistor DTFT, K represents a constant concerning the structure and technical process of the driving transistor DTFT itself. Since in an existing low temperature poly-silicon manufacturing process, the uniformity of the threshold voltages Vth of TFTs is poor, and the threshold voltages may drift in operation, and thus even if a same data voltage $V_{data}$ is input to the respective driving transistors DTFT, different driving currents are generated due to different threshold voltages of the driving transistors DTFT, so that the uniformity of the luminance of the AMOLED panel is poor.

In recent years, a touch function is widely used in various display panels especially in mobile displays, and nearly becomes a standard configuration of a smart phone. In the prior art, a display panel and a Touch Screen Panel (TSP) are manufactured separately, and then are bonded together. Such a technical process flow brings about a complex technical process and high cost of a functional panel in a display touch panel, and has adversely affected the lightness and thinness of the displays. The technique of TSP in cell integrates the display function with the touch function, and can utilize one technical process flow rather than two separate technical flows to realize the combination of the display function and the touch function. Therefore, the technique of TSP in cell not only has an advantage of low cost, but also brings about a simple technical process, and results in a lighter and thinner display touch panel. However, at present, there is no a better solution to the problem how to integrate a touch circuit with a pixel circuit perfectly.

SUMMARY

Embodiments of the present disclosure aim to provide a pixel circuit which can compensate a drift of a threshold voltage of a driving transistor, so as to improve the uniformity of the luminance of an OLED display panel; further, in the embodiments of the present disclosure, a touch circuit is integrated into the pixel circuit perfectly without increasing the complexity of a circuit structure and an operation thereof.

In the embodiments of the present disclosure, there is further provided a driving method for driving the above pixel circuit and a display device comprising the pixel circuit described as above, thus improving the display quality of the display device.

According to an embodiment of the present disclosure, there is provided a pixel circuit comprising an electroluminescent element, a driving transistor, a first switching unit, a compensating unit, an isolating unit and a storage capacitor, wherein the first switching unit controls to input a data voltage on a data line, and a first terminal of the first switching unit is connected to a first terminal of the storage capacitor, a second terminal of the first switching unit is connected to the data line;

a second terminal of the storage capacitor is connected to a gate of the driving transistor and a first terminal of the compensating unit;

the compensating unit controls the storage capacitor to pre-store a threshold voltage of the driving transistor, and a second terminal of the compensating unit is connected to a drain of the driving transistor;

a source of the driving transistor is connected to a power supply terminal, and the drain of the driving transistor is connected to a first terminal of the electroluminescent element;

the isolating unit isolates an electrical connection between the electroluminescent element and a grounded terminal, wherein a first terminal of the isolating unit is connected to a second terminal of the electroluminescent element, and a second terminal of the isolating unit is connected to the grounded terminal.

In an example, the electroluminescent element is an Organic Light Emitting Diode, the first switching unit is a first switching transistor, the compensating unit is a compensating transistor, and the isolating unit is an isolating transistor;

a gate of the first switching transistor is connected to a first scan signal terminal, a source thereof is connected to the first terminal of the storage capacitor, a drain thereof is connected to the data line;

the second terminal of the storage capacitor is connected to the gate of the driving transistor and a drain of the compensating transistor;

a gate of the compensating transistor is connected to a first control signal terminal, a source thereof is connected to a drain of the driving transistor;

the source of the driving transistor is connected to the power supply terminal, the drain of the driving transistor is connected to an anode of the OLED;

a gate of the isolating transistor is connected to a second control signal terminal, a source thereof is connected to a cathode of the OLED, and a drain thereof is connected to the grounded terminal.

In an example, the pixel circuit further comprises a resetting transistor, wherein a gate of the resetting transistor is connected to the source of the isolating transistor, a source of the resetting transistor is connected to the first terminal of the storage capacitor, and a drain thereof is connected to the second control signal terminal.

In an example, the pixel circuit is further connected to a touch circuit, wherein the touch circuit comprises a charging transistor, a coupling capacitor, a sensing electrode, an amplifying transistor and a second switching transistor, a second scan signal terminal and a sensing line;

wherein a gate of the charging transistor is connected to a third control signal terminal, a source thereof is connected to the second terminal of the storage capacitor, a drain thereof is connected to the sensing electrode;

a first terminal of the coupling capacitor is connected to the sensing electrode, and a second terminal thereof is connected to the second scan signal terminal;

a gate of the amplifying transistor is connected to the sensing electrode, a source thereof is connected to the power supply terminal, a drain thereof is connected to a source of the second switching transistor;

a gate of the second switching transistor is connected to the second scan signal terminal, and a drain thereof is connected to the sensing line.

In an example, the third control signal terminal is the first scan signal terminal.

In an example, all of the transistors have a same type of channel.

In an embodiment of the present disclosure, there is further provided a driving method for driving the above pixel circuit, wherein the driving method comprises steps of:

S1, applying a scan signal at the first scan signal terminal and applying a control signal at the first control signal terminal to turn on the first switching transistor and the compensating transistor, and applying a control signal at the second control signal terminal to turn off the isolating transistor, so as to write the threshold voltage of the driving transistor and the data voltage on the data line to the storage capacitor;

S2, applying a scan signal at the first scan signal terminal and applying a control signal at the first control signal terminal to turn off the first switching transistor and the compensating transistor, and applying a control signal at the second control signal terminal to turn on the isolating transistor, so as to drive the OLED to emit light using the voltage stored in the storage capacitor.

In an example, prior to the step S1, the method further comprises:

applying a scan signal at the first scan signal terminal to turn off the first switching transistor, applying control signals at the first control signal terminal and the second control signal terminal respectively to turn on the compensating transistor, the isolating transistor, and the resetting transistor so as to reset the storage capacitor.

In an example, the step S1 further comprises: applying a scan signal at the first scan signal terminal to turn on the charging transistor, and applying a scan signal at the second scan signal terminal to turn off the second switching transistor, so as to charge the coupling capacitor by the power supply terminal via the driving transistor and the charging transistor;

the step S2 further comprises: applying a scan signal at the first scan signal terminal to turn off the charging transistor, applying a scan signal at the second scan signal terminal to turn on the second switching transistor, and monitoring a variation of a current on the sensing line.

In an embodiment of the present disclosure, there is further provided a display device comprising any of the pixel circuits as above.

In the pixel circuit provided in the embodiments of the present disclosure, when the data voltage is written to the storage capacitor, the threshold voltage of the driving transistor and the data voltage are pre-stored in the storage capacitor by means of a diode connection formed by the driving transistor, so that the drift of the threshold voltage can be compensated effectively, and thus the uniformity and the stability of the driving current are maintained. Further, in the embodiment of the present disclosure, the scan signal for the pixel circuit is multiplexed in the touch circuit, and the coupling capacitor in the touch circuit is charged simultaneously while the storage capacitor is charged, and thus, the integration of the touch circuit into the pixel circuit can be realized perfectly without increasing the complexity of a circuit structure and an operation thereof.

DETAILED DESCRIPTION OF THE PREFERRED EMBODIMENTS

A detailed description will be given to specific implementations of embodiments of the present disclosure with reference to accompanying drawings. The following embodiments only illustrate the principle of the present disclosure, but do not limit the scope of the present disclosure in any way.

First Embodiment

Figure 1:
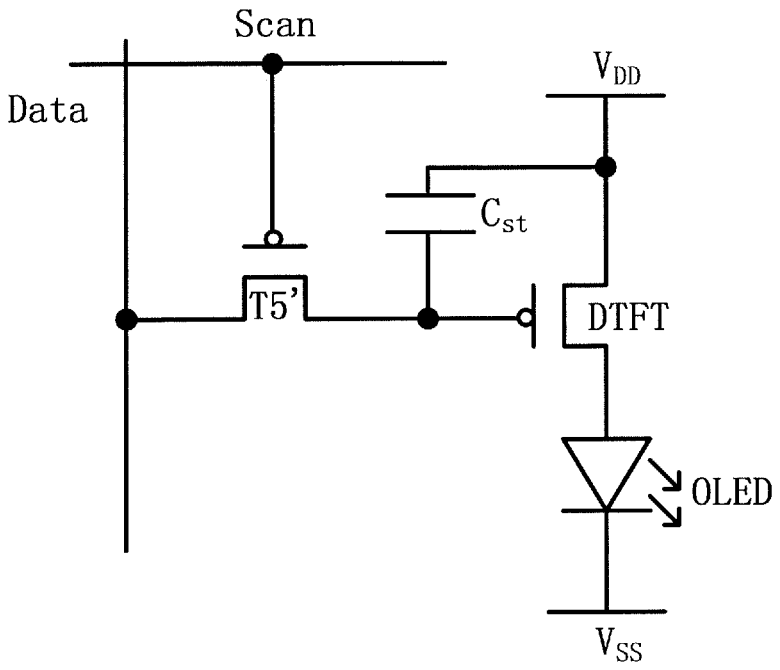
FIG. 1 is a schematic structure diagram of a pixel circuit in the prior art.
Figure 2:
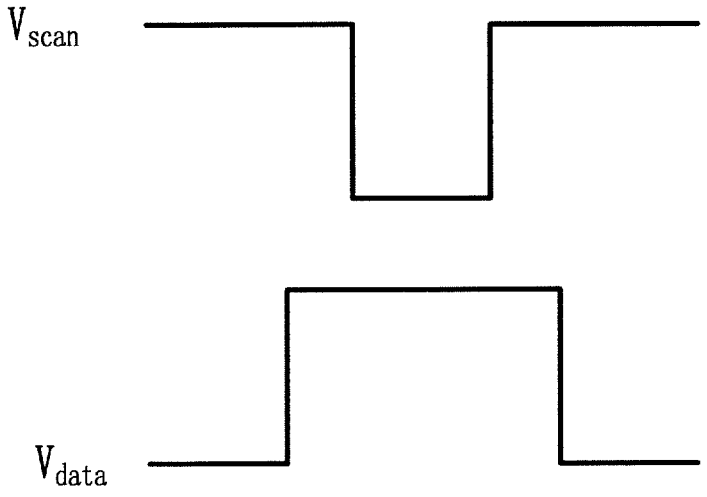
FIG. 2 is a driving timing diagram of the pixel circuit shown in FIG. 1.
Figure 3:
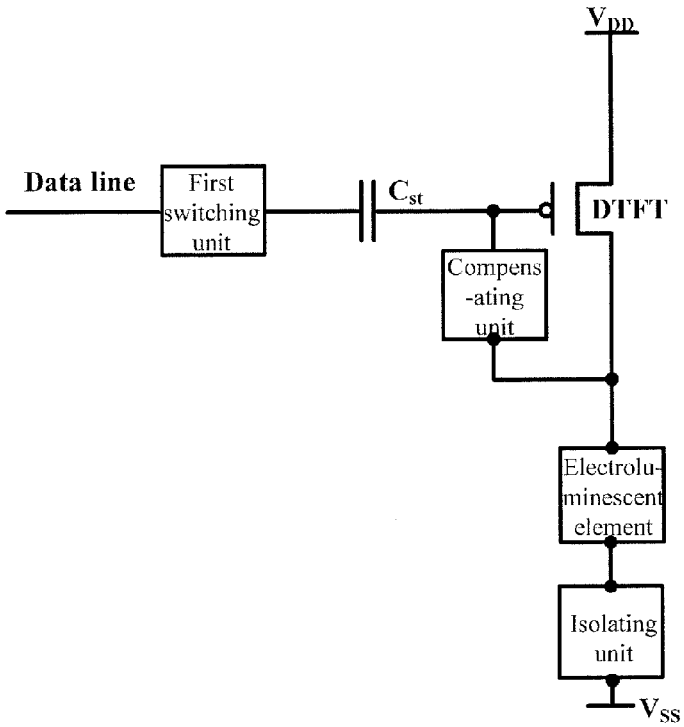
FIG. 3 is a schematic block diagram of a pixel circuit according to a first embodiment of the present disclosure.

In the present embodiment, a structure of a pixel circuit in an OLED display comprising OLEDs having a common cathode is taken as an example for illustration. As illustrated in FIG. 3, the pixel circuit in the present embodiment of the present disclosure comprises an electroluminescent element, a driving transistor, a first switching unit, a compensating unit, an isolating unit and a storage capacitor, wherein the first switching unit controls to input a data voltage on a data line, and a first terminal of the first switching unit is connected to a first terminal of the storage capacitor, a second terminal of the first switching unit is connected to the data line, a second terminal of the storage capacitor is connected to a gate of the driving transistor and a first terminal of the compensating unit; the compensating unit controls the storage capacitor to pre-store the threshold voltage of the driving transistor, and a second terminal of the compensating unit is connected to a drain of the driving transistor; a source of the driving transistor is connected to a power supply terminal, and the drain of the driving transistor is connected to a first terminal of an electroluminescent element; the isolating unit isolates an electrical connection between the electroluminescent element and a grounded terminal, wherein a first terminal of the isolating unit is connected to a second terminal of the electroluminescent element, a second terminal of the isolating unit is connected to the grounded terminal.

Figure 4:
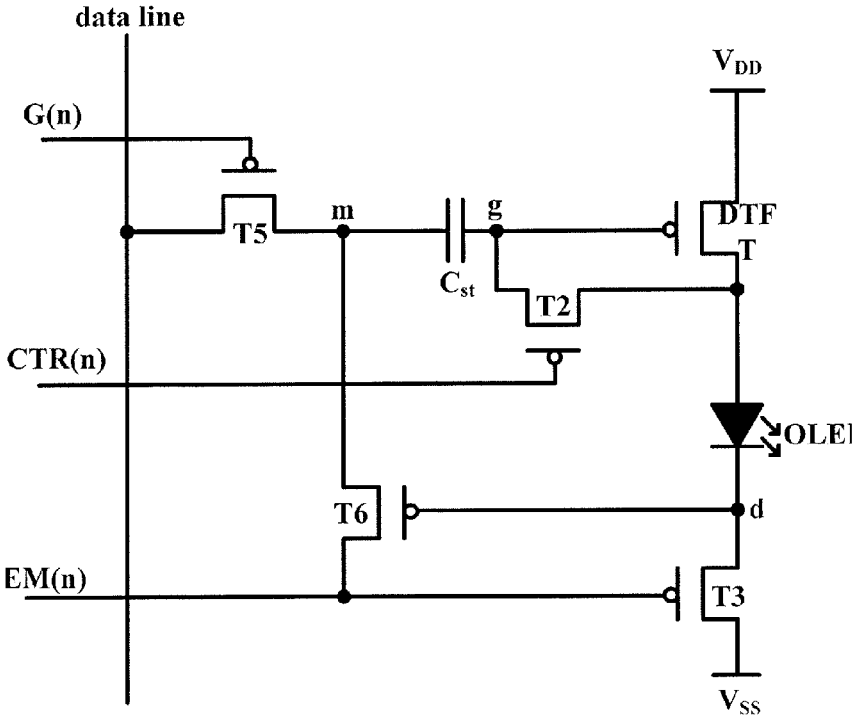
FIG. 4 is a schematic structure diagram of the pixel circuit according to the first embodiment of the present disclosure.

FIG. 4 shows a pixel circuit in the present embodiment of the present disclosure, wherein the pixel circuit comprises a driving transistor DTFT, a storage capacitor $C_{st}$, an OLED as the electroluminescent element, a first switching transistor T5 as the first switching unit, a compensating transistor T2 as the compensating unit, and an isolating transistor T3 as the isolating unit, and the pixel circuit further comprises a power supply terminal $V_{DD}$, a grounded terminal $V_{SS}$, a first scan signal terminal for supplying a scan signal to turn on or turn off the first switching transistor, and a data line for writing a data voltage to the pixel via the first switching transistor.

A gate of the first switching transistor T5 is connected to the first scan signal terminal, a source thereof is connected to a first terminal of the storage capacitor $C_{st}$, a drain thereof is connected to the data line, wherein the first switching transistor T5 supplies the data voltage on the data line to the storage capacitor $C_{st}$ under the control of a scan signal supplied by the first scan signal terminal, and the storage capacitor $C_{st}$ maintains the voltage; a second terminal of the storage capacitor $C_{st}$ is connected to a gate of the driving transistor DTFT and a drain of the compensating transistor T2.

A gate of the compensating transistor T2 is connected to a first control signal terminal, a source thereof is connected to a drain of the driving transistor DTFT; a source of the driving transistor DTFT is connected to the power supply terminal $V_{DD}$, the drain of the driving transistor DTFT is connected to an anode of the OLED; the compensating transistor T2 is turned on under the control of a control signal supplied by the first control signal terminal, so that the gate and drain of the driving transistor DTFT are connected to form a diode connection, thus ensuring that the driving transistor DTFT is in a current saturation region; under driving of the power supply terminal $V_{DD}$, a threshold voltage of the driving transistor DTFT is stored in the storage capacitor $C_{st}$ by a method in which the storage capacitor $C_{st}$ is charged by the driving transistor DTFT, thus achieving a purpose of compensating the threshold voltage; the driving transistor DTFT is turned on or turned off under the control of a voltage stored in the storage capacitor $C_{st}$, and a current flowing through the driving transistor DTFT is controlled by the voltage stored in the storage capacitor $C_{st}$.

A gate of the isolating transistor T3 is connected to a second control signal terminal, a source thereof is connected to a cathode of the OLED, and a drain thereof is connected to the grounded terminal $V_{SS}$, wherein the isolating transistor T3 is turned on or turned off under the control of a control signal supplied from the second control signal terminal; when the data voltage signal on the data line is written to the pixel circuit, the isolating transistor T3 is turned off, so as to prevent the isolating transistor T3 from charging the OLED if the isolating transistor T3 is turned on, thus preventing the threshold voltage of the driving transistor DTFT pre-stored in the storage capacitor $C_{st}$ from drifting and avoiding the flicker of the OLED in display.

The pixel circuit in the present embodiment of the present disclosure can further comprise a resetting transistor T6, wherein a gate of the resetting transistor T6 is connected to the source of the isolating transistor T3, a source of the resetting transistor T6 is connected to the first terminal of the storage capacitor $C_{st}$, a drain thereof is connected to the second control signal terminal. The isolating transistor T3 is firstly turned on by the control signal supplied by the second control signal terminal, so that the gate of the resetting transistor T6 is connected to the grounded terminal $V_{SS}$, thus the resetting transistor T6 being turned on. Since the resetting transistor T6 is turned on, voltage of the control signal EM(n) from the second control signal terminal pulls down the storage capacitor $C_{st}$, so that the driving transistor DTFT is turned on, and then the OLED is driven to emit light by the driving transistor DTFT. Meanwhile, since the resetting transistor T6 is turned on, a fixed potential is supplied to the first terminal of the storage capacitor, and the second terminal of the storage capacitor is in a float state, so that the potential at the gate of the driving transistor DTFT is clamped and thus is free of the influence of the noise, avoiding the fluctuation of the potential at the gate of the driving transistor DTFT.

The pixel circuit in the present embodiment of the present disclosure can be compatible to the data driving chip for voltage amplitude modulation, and can also be compatible to the data driving chip for pulse width modulation, and necessary voltage signals are supplied to the first scan signal terminal, the data line, the first control signal terminal and the second control signal terminal, etc. by the data driving chips.

Another advantage of the pixel circuit of the present embodiment of the present disclosure lies in that all of the transistors are of a single channel type, that is, the transistors are all P channel type transistors, thus decreasing the complexity and the production cost of the manufacturing process. Naturally, it is easy for those skilled in the art to deem that all of the transistors in the pixel circuit of the present embodiment of the present disclosure can be replaced by N channel type transistors or Complementary Metal Oxide Semiconductors CMOS; in addition, the present embodiment can be applied to an OLED display comprising OLEDs having a common anode, and is not limited to the OLED display comprising OLEDs having a common cathode, and the details are omitted.

Figure 5:
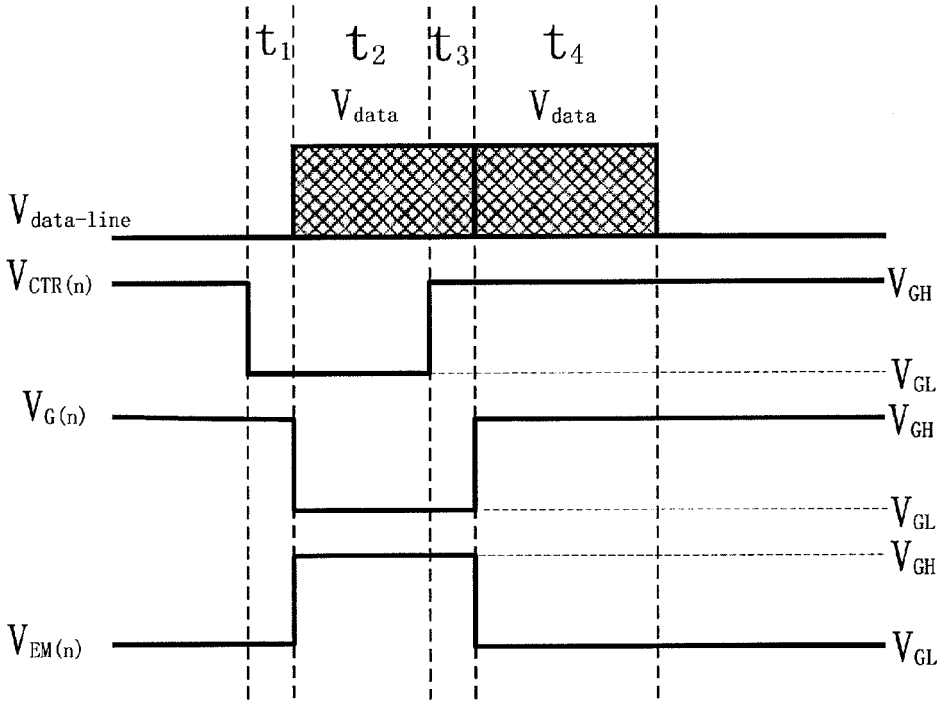
FIG. 5 is a driving timing diagram of the pixel circuit shown in FIG. 4.

In an embodiment of the present disclosure, there is further provided a driving method for driving the pixel circuit described above. FIG. 5 shows a schematic driving timing diagram thereof. In FIG. 5, variations of the scan signal voltage G(n) at the first scan signal terminal, the data voltage $V_{data}$ on the data line, the control signal voltage CTR(n) at the first control signal terminal, and the control signal voltage EM(n) at the second control signal terminal in one frame period are illustrated. In a period t1, that is, before the data voltage is written to the pixel circuit, the storage capacitor $C_{st}$ needs to be discharged to eliminate the influence of data of the last frame. The driving method mainly comprises two periods, that is, a compensating period for compensating the threshold voltage of the driving transistor DTFT (i.e., the period $t_2$) and a driving and displaying period for driving the OLED to display (i.e., including the periods $t_3$ and $t_4$), wherein the data is written during the compensating period. During the period for compensating the threshold voltage of the driving transistor DTFT, under the control of a plurality of stages of voltage signals, the compensating transistor T2 and the driving transistor DTFT control the storage capacitor $C_{st}$ to pre-store the threshold voltage of the driving transistor and the data voltage $V_{data}$ on the data line, and the storage capacitor $C_{st}$ maintains the threshold voltage and the data voltage $V_{data}$ unchanged during the driving and displaying period. Hereinafter, the above periods are described in detail with reference to FIGS. 6-9.

Figure 6:
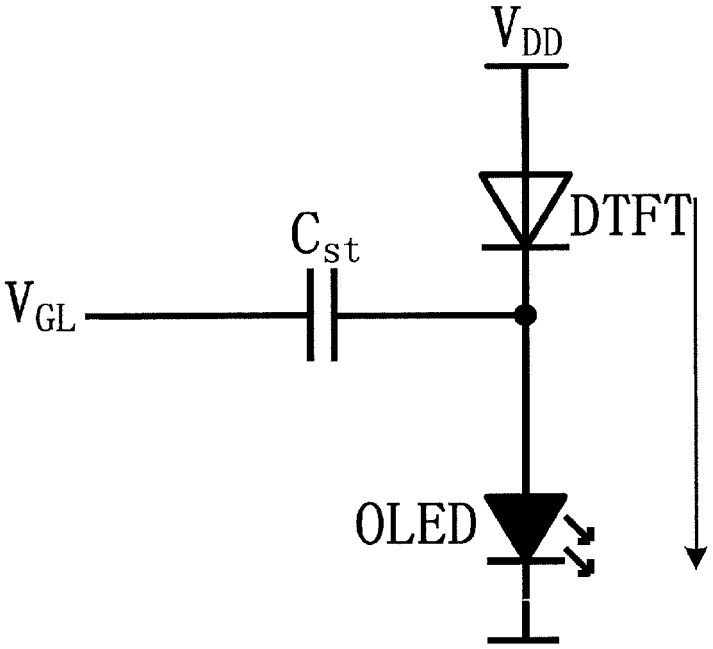
FIG. 6 is a schematic diagram of an equivalent circuit structure of the pixel circuit shown in FIG. 4 during a period $t_1$.

A Resetting Period $t_1$:

FIG. 6 shows an equivalent circuit diagram of the pixel circuit during the period, wherein the scan signal voltage G(n) at the first scan signal terminal is at a high level, the control signal voltage CTR(n) at the first control signal terminal and the control signal voltage EM(n) at the second control signal terminal are at a low level, the resetting transistor T6, the isolating transistor T3 and the compensating transistor T2 are turned on, the first switching transistor T5 is turned off, and the gate and the drain of the driving transistor DTFT are connected to form a diode connection. The period is a resetting period for eliminating the residual voltage signals of the last period.

Figure 7:
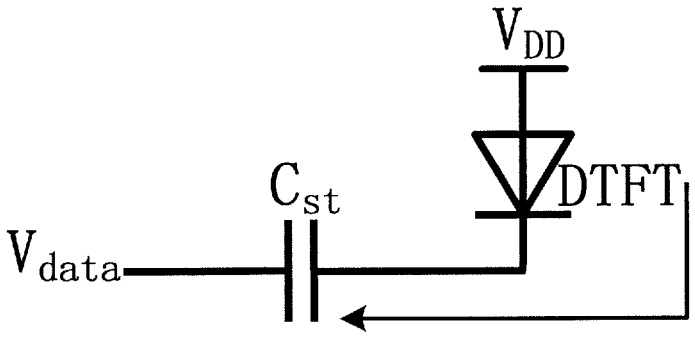
FIG. 7 is a schematic diagram of an equivalent circuit structure of the pixel circuit shown in FIG. 4 during a period $t_2$.

A Compensating Period $t_2$:

FIG. 7 shows an equivalent circuit diagram of the pixel circuit during the period, during the period, the OLED is in an off state, and the storage capacitor $C_{st}$ pre-stores an initial voltage approximate to the threshold voltage of the driving transistor DTFT and the data voltage $V_{data}$ on the data line. In particular, when the data voltage $V_{data}$ is written to the pixel circuit, the scan signal voltage G(n) at the first scan signal terminal changes to a low level, and the control signal voltage CTR(n) at the first control signal terminal is maintained unchanged at a low level, so that the first switching transistor T5 and the compensating transistor T2 are in a turn-on state, the control signal voltage EM(n) at the second control signal terminal changes to a high level, the isolating transistor T3 is turned off. The data voltage $V_{data}$ on the data line is supplied to the storage capacitor $C_{st}$, so that the potential at the node m reaches to $V_{data}$. Since the driving transistor DTFT is in a diode connection, it is ensured that the driving transistor DTFT operates in a current saturation region, and that a stable driving current is supplied from the power supply terminal $V_{DD}$ via the driving transistor DTFT to charge the storage capacitor $C_{st}$, so that the potential at the drain of the driving transistor DTFT reaches $V_{DD}$-$|V_{thd}|$, at the same time, the potential at the node d is pulled up to $V_{DD}-|V_{thd}|-V_{tho}$, wherein $|V_{thd}|$ represents the threshold voltage of the driving transistor, and $V_{tho}$ represents the threshold voltage of the OLED; since the potential VDD is relatively higher, the potential at the node d causes the resetting transistor T6 also in a turn-off state, so as to prevent the high level signal at the second control signal terminal from entering the first terminal of the storage capacitor $C_{st}$.

Figure 8:
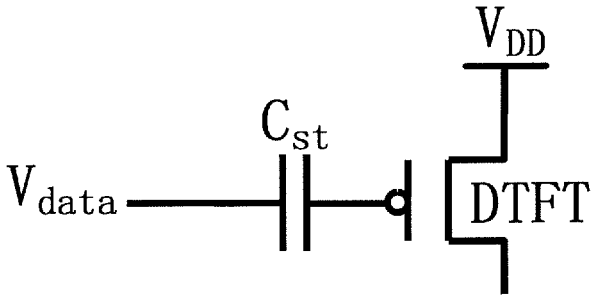
FIG. 8 is a schematic diagram of an equivalent circuit structure of the pixel circuit shown in FIG. 4 during a period $t_3$.

An Isolating Period t3:

FIG. 8 shows an equivalent circuit diagram of the pixel circuit during the period, during the period, the scan signal voltage G(n) at the first scan signal terminal and the control signal voltage EM(n) at the second control signal terminal are maintained unchanged, and the control signal voltage CTR(n) at the first control signal terminal changes to a high level, the compensating transistor T2 is turned off; though the driving transistor DTFT is no longer in a diode connection, the potentials at respective nodes are maintained unchanged: at this time, the potential at the gate of the driving transistor DTFT is $V_g=V_{DD}-|V_{thd}|$, and the potential at the node m is $V_{data}$. The present period is an isolating period in which it is avoided that noise is input since signals are changed simultaneously. It should be understood that the isolating period $t_3$ is only an option in the present embodiment, and the operation therein can be performed in the following period $t_4$.

Figure 9:
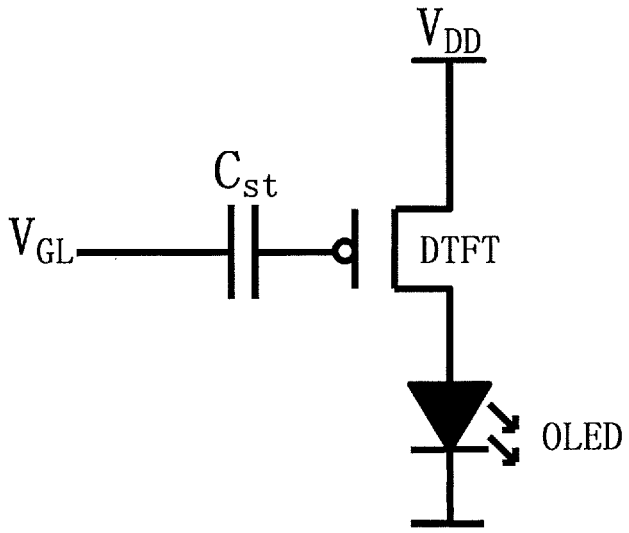
FIG. 9 is a schematic diagram of an equivalent circuit structure of the pixel circuit shown in FIG. 4 during a period $t_4$.

A Driving and Displaying Period $t_4$:

FIG. 9 shows an equivalent circuit diagram of the pixel circuit during the period, during the period, the OLED is in a conduction state, and the voltage stored in the storage capacitor $C_{st}$ drives the OLED to display. In particular, the scan signal voltage G(n) at the first scan signal terminal changes to a high level $V_{GH}$, so that the first switching transistor T5 is turned off, and the control signal voltage CTR(n) at the first control signal terminal is maintained unchanged, that is, at a high level. the control signal voltage EM(n) at the second control signal terminal changes to a low level, the isolating transistor T3 and the resetting transistor T6 are in a turn-on state, so that the potential at the node m changes to a low level $V_{GL}$, and the OLED is in the conduction state; since the gate of the driving transistor DTFT is floated, the potential at the gate of the driving transistor DTFT also changes to $V_g=V_{DD}-|V_{thd}|+V_{GL}-V_{data}$; the gate-source voltage of the driving transistor DTFT is $V_{sg}=V_s-V_g=V_{DD}-(V_{DD}-|V_{thd}|+V_{GL}-V_{data})=|V_{thd}|+V_{data}-V_{GL}$; at this time, the driving transistor DTFT is in a saturation state, and supplies a stable driving current to the OLED, and the driving current for the OLED is $$I_{oled}=K(V_{sg}-|V_{thd}|)^2=K(|V_{thd}|+V_{data}-V_{GL}-|V_{thd}|)^2=K(V_{data}-V_{GL})^2$$

wherein K represents a constant related to the technical process and the design of the driving circuit.

It can be seen that the driving current $I_{oled}$ is independent of the threshold voltage of the driving transistor DTFT, and thus the drift of the threshold voltage of the driving transistor DTFT has no influence on the current of the drain of the driving transistor DTFT (i.e., the driving current $I_{oled}$ of the pixel circuit); meanwhile, the formula for the current of the circuit does not contain the term of power supply voltage ($V_{DD}$ or $V_{SS}$), thus removing the influence of the internal resistance on the light-emitting current, so that the OLED operates stably in display, and thus the display quality is greatly improved.

Second Embodiment

Figure 10:
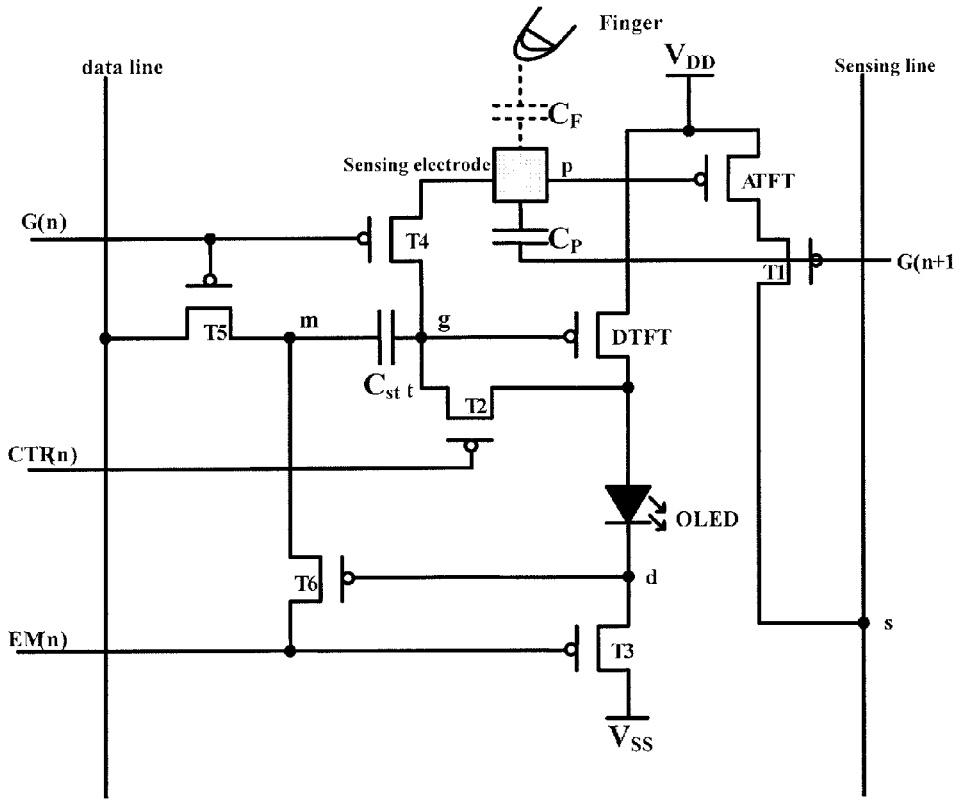
FIG. 10 is a schematic structure diagram of a pixel circuit according to a second embodiment of the present disclosure.

In the embodiment of the present disclosure, a touch circuit is further integrated into the pixel circuit perfectly. Now, detailed descriptions are given to the present embodiment on the basis of the pixel circuit illustrated in the first embodiment of the present disclosure. FIG. 10 illustrates a pixel circuit according to the second embodiment of the present disclosure, wherein, besides an OLED, a driving transistor DTFF, a first switching transistor T5, a compensating transistor T2, an isolating transistor T3, a resetting transistor T6 and a storage capacitor $C_{st}$, the pixel circuit further comprises an integrated touch circuit. The touch circuit comprises a charging transistor T4, a coupling capacitor $C_P$, a sensing electrode, an amplifying transistor ATFT and a second switching transistor T1; wherein a gate of the charging transistor T4 is connected to a third control signal terminal, a source thereof is connected to a second terminal of the storage capacitor $C_{st}$, a drain thereof is connected to the sensing electrode; under the control of a control signal supplied from the third control signal terminal, the charging transistor T4 is turned on; while the power supply terminal $V_{DD}$ charges the storage capacitor $C_{st}$, a driving voltage is supplied to the coupling capacitor $C_p$ and is held in the coupling capacitor $C_p$; a first terminal of the coupling capacitor $C_p$ is connected to the sensing electrode, and a second terminal thereof is connected to the second scan signal terminal; a gate of the amplifying transistor ATFT is connected to the sensing electrode, a source thereof is connected to the power supply terminal $V_{DD}$, a drain thereof is connected to the source of the second switching transistor T1, and the amplifying transistor ATFT is mainly used for amplifying a touch signal of a finger; a gate of the second switching transistor T1 is connected to the second scan signal terminal, a drain thereof is connected to a sensing line, and under the control of the scan signal supplied from the second scan signal terminal, the second switching transistor T1 is turned on and transmits the amplified touch signal to the sensing line; then information on the touch can be obtained by detecting variation of signal on the sensing line. Further, in order to simplify the technical process and reduce the cost, the third control signal terminal can be the first scan signal terminal; by multiplexing the scan signal in the pixel circuit to charge the coupling capacitor $C_p$ in the touch circuit, the integration of the touch circuit into the pixel circuit can be realized perfectly without increasing the complexity of the circuit structure and the operation thereof. Also, in the data driving chip of the pixel circuit in the present embodiment, it is unnecessary to arrange a special control signal driving portion for the touch circuit, thus simplifying the circuit structure and the technical process flow.

In the embodiment of the present disclosure, there is further provided a driving method for driving the pixel circuit described above. FIG. 10 shows a schematic driving timing diagram thereof. In FIG. 10, variations of the scan signal voltage G(n) at the first scan signal terminal, the scan signal voltage G(n+1) at the second scan signal terminal, the data voltage $V_{data}$ on the data line, the control signal voltage CTR(n) at the first control signal terminal, and the control signal voltage EM(n) at the second control signal terminal in one frame period are illustrated. Hereinafter, the above periods are described in detail with reference to FIGS. 12-15.

Figure 12:
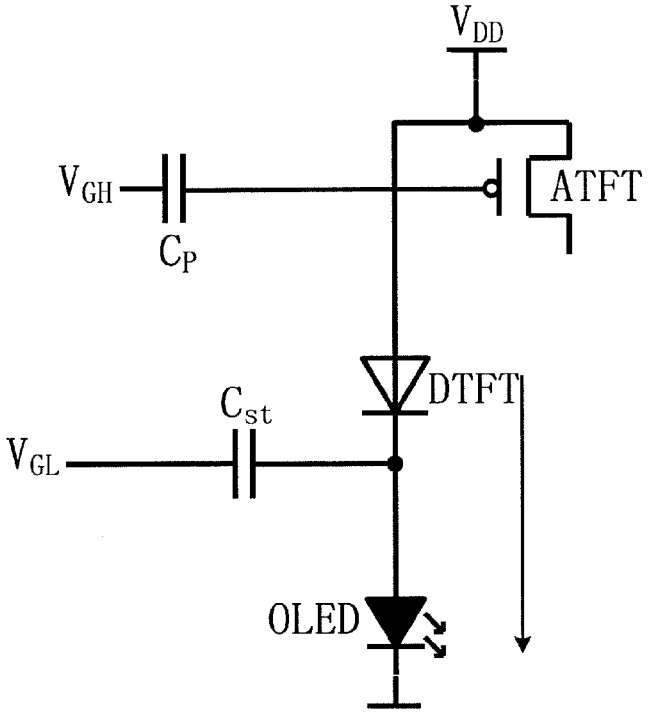
FIG. 12 is a schematic diagram of an equivalent circuit structure of the pixel circuit shown in FIG. 10 during a period $t_1$.

A Resetting Period $t_1$:

FIG. 12 shows an equivalent circuit diagram of the pixel circuit during the period, wherein during the period $t_1$, the scan signal voltage G(n) at the first scan signal terminal and the scan signal voltage G(n+1) at the second scan signal terminal are at a high level, the control signal voltage CTR(n) at the first control signal terminal and the control signal voltage EM(n) at the second control signal terminal are at a low level, the resetting transistor T6, the isolating transistor T3 and the compensating transistor T2 are turned on, the first switching transistor T5, the charging transistor T4 and the second switching transistor T1 are turned off, and the gate and the drain of the driving transistor DTFT are connected to form a diode connection, and the drain of the amplifying transistor ATFT is in an open-circuit state. The period is a resetting period for eliminating the residual voltage signals of the last period.

Figure 13:
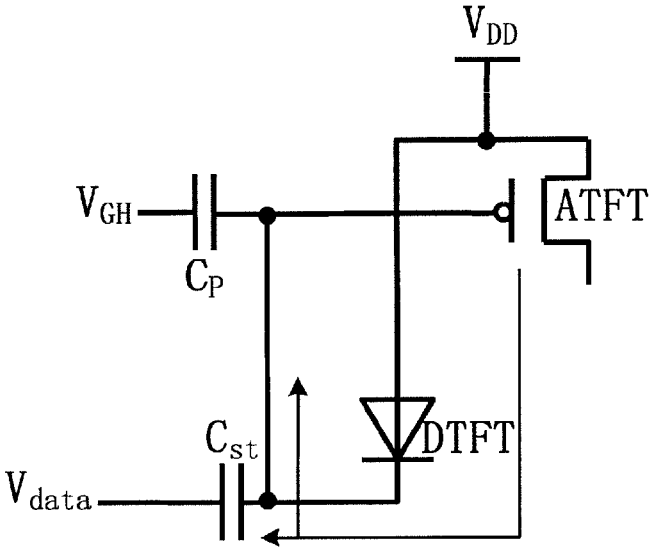
FIG. 13 is a schematic diagram of an equivalent circuit structure of the pixel circuit shown in FIG. 10 during a period $t_2$.

A Compensating Period $t_2$:

FIG. 13 shows an equivalent circuit diagram of the pixel circuit during the period, during the period, the OLED is in a turn-off state, and the storage capacitor $C_{st}$ pre-stores an initial voltage approximate to the threshold voltage of the driving transistor DTFT and the data voltage $V_{data}$ on the data line; at the same time, the coupling capacitor $C_p$ is charged. In particular, when the data voltage $V_{data}$ is written to the pixel, the scan signal voltage G(n) at the first scan signal terminal changes to a low level, the first switching transistor T5 and the charging transistor T4 are in a turn-on state; the scan signal voltage G(n+1) at the second scan signal terminal is maintained unchanged at a high level, the control signal voltage CTR(n) at the first control signal terminal is maintained unchanged at a low level, so that the first switching transistor T5 and the compensating transistor T2 are in a turn-on state, the control signal voltage EM(n) at the second control signal terminal changes to a high level, the isolating transistor T3 is turned off. The data voltage $V_{data}$ on the data line is supplied to the storage capacitor $C_{st}$, so that the potential at the node m reaches to $V_{data}$. Since the driving transistor DTFT is in a diode connection, it is ensured that the driving transistor DTFT operates in a current saturation region, and that the a stable driving current is supplied from the power supply terminal $V_{DD}$ via the driving transistor DTFT to charge the storage capacitor $C_{st}$, so that the potential at the drain of the driving transistor DTFT reaches $V_{DD}-|V_{thd}|$, and the potential at the node p is also charged to $V_{DD}-|V_{thd}|$; at the same time, the potential at the node d is pulled up to $V_{DD}-|V_{thd}|-V_{tho}$, wherein $|V_{thd}|$ represents the threshold voltage of the driving transistor, and $V_{tho}$ represents the threshold voltage of the OLED; since the potential VDD is relatively higher, the potential at the node d causes the resetting transistor T6 also in a turn-off state, so as to prevent the high level signal at the second control signal terminal from entering the first terminal of the storage capacitor $C_{st}$.

Figure 14:
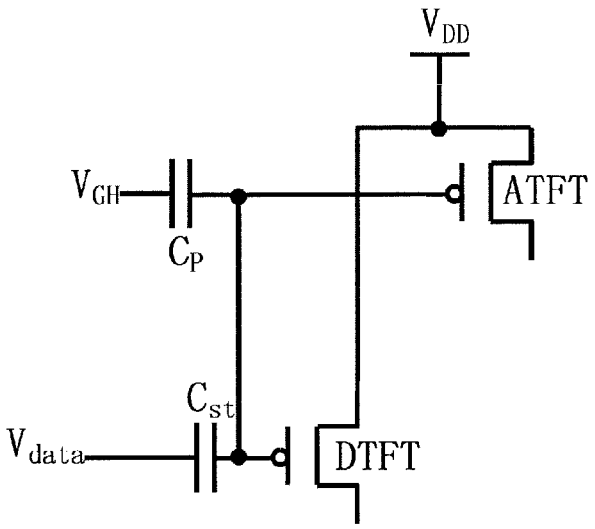
FIG. 14 is a schematic diagram of an equivalent circuit structure of the pixel circuit shown in FIG. 10 during a period $t_3$.

An Isolating Period t3:

FIG. 14 shows an equivalent circuit diagram of the pixel circuit during the period, during the period, the scan signal voltage G(n) at the first scan signal terminal, the scan signal voltage G(n+1) at the second scan signal terminal and the control signal voltage EM(n) at the second control signal terminal are maintained unchanged, and the control signal voltage CTR(n) at the first control signal terminal changes to a high level, the compensating transistor T2 is turned off; though the driving transistor DTFT is no longer in a diode connection, the potentials at respective nodes are maintained unchanged: at this time, the potential at the gate of the driving transistor DTFT is $V_g=V_{DD}-|V_{thd}|$, and the potential at the node m is $V_{data}$, the potential at the node p is $V_{DD}-|V_{thd}|$. The present period is an isolating period in which it is avoided that noise is input since signals are changed simultaneously. It should be understood that the isolating period $t_3$ is only an option in the embodiment, and the operation therein can be performed in the following period $t_4$.

Figure 15:
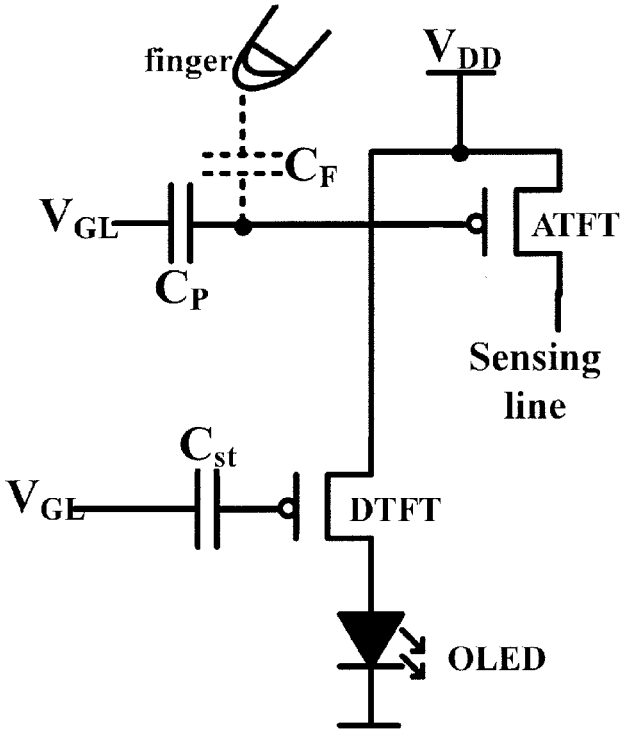
FIG. 15 is a schematic diagram of an equivalent circuit structure of the pixel circuit shown in FIG. 10 during a period $t_4$.

A Driving and Displaying Period $t_4$:

FIG. 15 shows an equivalent circuit diagram of the pixel circuit during the period, during the period, the OLED is in a conduction state, and the voltage stored in the storage capacitor $C_{st}$ drives the OLED to display. The amplified touch signal is transmitted to the sensing line, and the information on the touch is obtained by monitoring the variation of the signal on the sensing line. In particular, the scan signal voltage G(n) at the first scan signal terminal changes to a high level, so that the first switching transistor T5 is turned off, the scan signal voltage G(n+1) at the second scan signal terminal changes to a low level, so that the second switching transistor T1 is in a turn-on state; the control signal voltage CTR(n) at the first control signal terminal is maintained unchanged at a high level, the control signal voltage EM(n) at the second control signal terminal changes to a low level, the isolating transistor T3 and the resetting transistor T6 are in a turn-on state, so that the potential at the node m changes to a low level $V_{GL}$, and the OLED is in the conduction state; since the gate of the driving transistor DTFT is floated, the potential at the gate of the driving transistor DTFT also changes to $V_g=V_{DD}-|V_{thd}|+V_{GL}-V_{data}$; the gate-source voltage of the driving transistor DTFT is $V_{sg}=V_s-V_g=V_{DD}-(V_{DD}-|V_{thd}|+V_{GL}-V_{data})=|V_{thd}|+V_{data}-V_{GL}$; at this time, the driving transistor DTFT is in a saturation state, and supplies a stable driving current to the OLED, and the driving current for the OLED is $$I_{oled}=K(V_{sg}-|V_{thd}|)^2=K(|V_{thd}|+V_{data}-V_{GL}-|V_{thd}|)^2=K(V_{data}-V_{GL})^2,$$

wherein K represents a constant related to the technical process and the design of the driving circuit.

It can be seen that the driving current $I_{oled}$ is independent of the threshold voltage of the driving transistor DTFT, and thus the drift of the threshold voltage of the driving transistor DTFT has no influence on the current of the drain of the driving transistor DTFT (i.e., the driving current $I_{oled}$ of the pixel circuit); meanwhile, in the pixel circuit, the influence of the internal resistance on the light-emitting current is removed, achieving the stable display and flickerless of the OLED, and thus greatly improving the display quality.

Since the scan signal voltage G(n+1) at the second scan signal terminal changes downward, the gate of the amplified transistor ATFT is floated, and the potential at the node p is pulled down simultaneously. How much the potential at the node p changes downward depends on two cases: a case in which there is a finger touch and another case in which there is no any finger touch. In the case wherein there is a finger touch, since a sensing capacitor $C_F$ is formed between the finger and the sensing electrode, and thus the potential at the node p is $V_p=V_{DD}-|V_{thd}|+(V_{GL}-V_{GH})\times C_p/(C_p+C_F)$.

The gate-source voltage of the amplifying transistor ATFT is $$\begin{aligned} V_{sg} &= V_s - V_g \\ &= V_{DD} - [V_{DD} - |V_{thd}| + (V_{GL} - V_{GH}) \times C_p / (C_p + C_F)] \\ &= |V_{thd}| + (V_{GH} - V_{GL}) \times C_p / (C_p + C_F). \end{aligned}$$

Therefore, the sensing current flowing through the sensing line is $$\begin{aligned} I_{se} &= K_a(V_{sg} - |V_{tha}|)^2 \\ &= K_a(V_{sg} - |V_{tha}|)^2 \\ &= K_a[|V_{thd}| + (V_{GH} - V_{GL}) \times C_p / (C_p + C_F) - |V_{tha}|]^2. \end{aligned}$$

wherein $V_{th}$ represents the threshold voltage of the driving transistor, $V_{tha}$ represents the threshold voltage of the amplifying transistor ATFT, and $K_a$ represents a constant related to the technical process and design of the amplifying transistor ATFT.

In the case where there is no any finger touch, the potential at the node p is $V_p=V_{DD}-|V_{thd}|-(V_{GH}-V_{GL})$.

The gate-source voltage of the amplifying transistor ATFT is $$\begin{aligned} V_{sg} &= V_s - V_g \\ &= V_{DD} - [V_{DD} - |V_{thd}| - (V_{GH} - V_{GL})] \\ &= |V_{thd}| + V_{GH} - V_{GL}. \end{aligned}$$

The sensing current flowing through the sensing line is $$\begin{aligned} I_{se} &= K_a(V_{sg} - |V_{tha}|)^2 \\ &= K_a(V_{sg} - |V_{tha}|)^2 \\ &= K_a[|V_{thd}| + (V_{GH} - V_{GL}) - |V_{tha}|]^2. \end{aligned}$$

Figure 11:
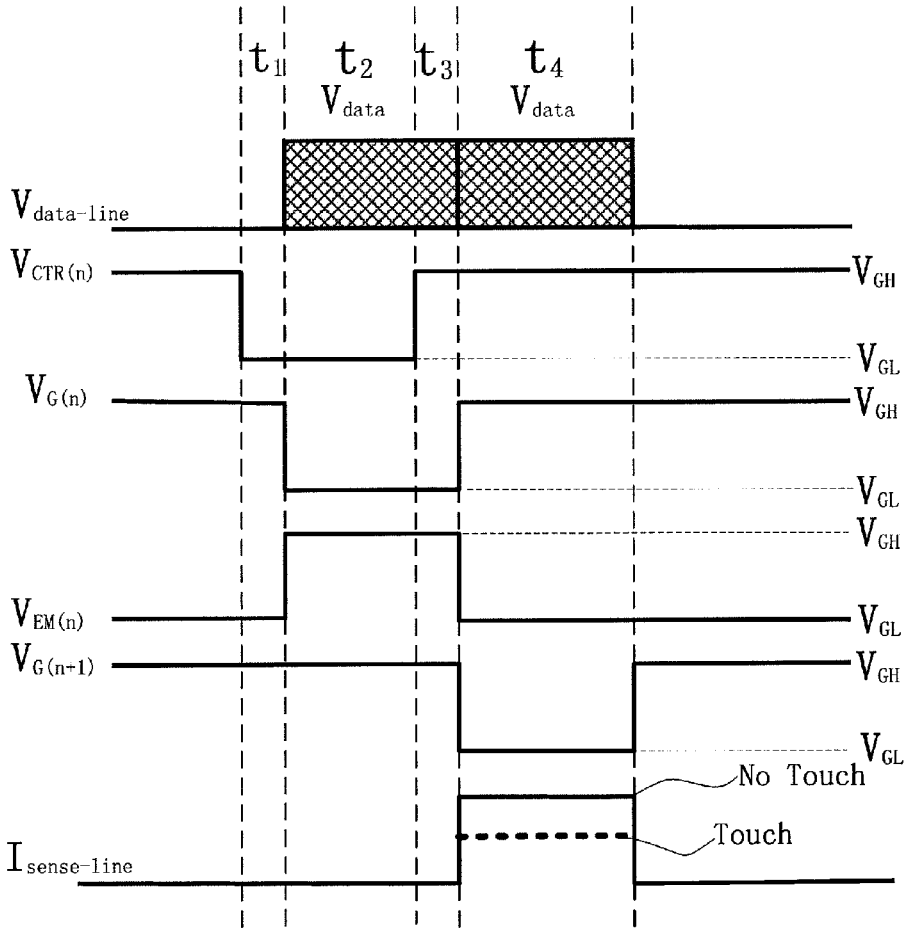
FIG. 11 is a driving timing diagram of the pixel circuit shown in FIG. 10.

Therefore, it can be determined that whether there is a finger touch at a certain location by monitoring the current on the sensing line, and the FIG. 11 shows the current difference $I_{sense\text{-}line}$ due to the touch.

The operations on the driving for one row of pixels to emit light and on determination of the touch on the row of pixels are realized during the above periods, and the touch circuit is integrated into the pixel circuit perfectly without increasing the complexity of the circuit structure and the operation of thereof.

Third Embodiment

In the embodiment of the present disclosure, there is provided a display device comprising the above pixel circuit. In particular, the display device comprises a plurality of pixel units each corresponding to any of the pixel circuits described as above. Since the pixel circuit can compensate the drift of the threshold voltage of the driving transistor, the OLED operates stably in display and does not flicker, thus ensuring that the display quality of the display device adopting OLED. Meanwhile, in the embodiments of the present disclosure, the control signal for the pixel circuit is multiplexed in the touch circuit, and the coupling capacitor is charged in the touch circuit via the charging transistor while the storage capacitor is charged, thus realizing the integration of the touch circuit into the pixel circuit perfectly; and by combining the display function and the touch function together, only one technical process flow rather than two separate technical process flows is necessary, thus the embodiments of the present disclosure not only has an advantage of low cost, but also makes the technical process simple and the display device more lighter and thinner.

The aforesaid only illustrates some embodiments of the present disclosure, and it should be noted that a number of modifications and variations can be made to the embodiments of the present disclosure by those skilled in the art without departing from the spirit and principle of the present invention, and such modifications and variation should be regarded as falling into the protection scope of the present invention.

What is claimed is:

1. A pixel circuit, characterized by comprising an electroluminescent element, a driving transistor, a first switching circuit, a compensating circuit, an isolating circuit, a storage capacitor and a resetting transistor, wherein the first switching circuit controls input of a data voltage on a data line under control of a first scan signal terminal, and a control terminal of the first switching circuit is connected to the first scan signal terminal, a first terminal of the first switching circuit is connected to a first terminal of the storage capacitor, a second terminal of the first switching circuit is connected to the data line;

a second terminal of the storage capacitor is connected to a gate of the driving transistor and a first terminal of the compensating circuit;

the compensating circuit controls the storage capacitor to pre-store a threshold voltage of the driving transistor under control of a first control signal terminal, a control terminal of the compensating circuit is connected to the first control signal terminal, and a second terminal of the compensating circuit is connected to a drain of the driving transistor;

a source of the driving transistor is connected to a power supply terminal, the drain of the driving transistor is connected to a first terminal of the electroluminescent element;

the isolating circuit isolates an electrical connection between the electroluminescent element and a grounded terminal under control of a second control signal terminal, wherein a control terminal of the isolating circuit is connected to the second control signal terminal, a first terminal of the isolating circuit is connected to a second terminal of the electroluminescent element, and a second terminal of the isolating circuit is connected to the grounded terminal; and a gate of the resetting transistor is connected to the first terminal of the isolating circuit, a source of the resetting transistor is connected to the first terminal of the storage capacitor, and a drain thereof is connected to the second control signal terminal.

2. The pixel circuit of claim 1, characterized in that the electroluminescent element is an Organic Light Emitting Diode, the first switching circuit is a first switching transistor, the compensating circuit is a compensating transistor, and the isolating circuit is an isolating transistor;

a gate of the first switching transistor is connected to the first scan signal terminal, a source thereof is connected to the first terminal of the storage capacitor, a drain thereof is connected to the data line;

the second terminal of the storage capacitor is connected to the gate of the driving transistor and a drain of the compensating transistor;

a gate of the compensating transistor is connected to the first control signal terminal, a source thereof is connected to the drain of the driving transistor;

the source of the driving transistor is connected to the power supply terminal, the drain of the driving transistor is connected to an anode of the OLED; and a gate of the isolating transistor is connected to the second control signal terminal, a source thereof is connected to a cathode of the OLED and the gate of the resetting transistor, and a drain thereof is connected to the grounded terminal.

3. The pixel circuit of claim 2, characterized in that the pixel circuit is further connected to a touch circuit, wherein the touch circuit comprises a charging transistor, a coupling capacitor, a sensing electrode, an amplifying transistor and a second switching transistor, a second scan signal terminal and a sensing line;

wherein a gate of the charging transistor is connected to a third control signal terminal, a source thereof is connected to the second terminal of the storage capacitor, a drain thereof is connected to the sensing electrode;

a first terminal of the coupling capacitor is connected to the sensing electrode, and a second terminal thereof is connected to the second scan signal terminal;

a gate of the amplifying transistor is connected to the sensing electrode, a source thereof is connected to the power supply terminal, a drain thereof is connected to the source of the second switching transistor; and a gate of the second switching transistor is connected to the second scan signal terminal, and a drain thereof is connected to the sensing line.

4. The pixel circuit of claim 2, characterized in that the pixel circuit is further connected to a touch circuit, wherein the touch circuit comprises a charging transistor, a coupling capacitor, a sensing electrode, an amplifying transistor and a second switching transistor, a second scan signal terminal and a sensing line;

wherein a gate of the charging transistor is connected to a third control signal terminal, a source thereof is connected to the second terminal of the storage capacitor, a drain thereof is connected to the sensing electrode;

a first terminal of the coupling capacitor is connected to the sensing electrode, and a second terminal thereof is connected to the second scan signal terminal;

a gate of the amplifying transistor is connected to the sensing electrode, a source thereof is connected to the power supply terminal, a drain thereof is connected to the source of the second switching transistor; and a gate of the second switching transistor is connected to the second scan signal terminal, and a drain thereof is connected to the sensing line.

5. The pixel circuit of claim 3, characterized in that the third control signal terminal is the first scan signal terminal.

6. The pixel circuit of claim 4, characterized in that the third control signal terminal is the first scan signal terminal.

7. The pixel circuit of claim 2, characterized in that all the transistors have a same type of channel.

8. A driving method for the pixel circuit of claim 2, characterized by comprising steps of:

applying a scan signal at the first scan signal terminal to turn off the first switching transistor, applying control signals at the first control signal terminal and the second control signal terminal respectively to turn on the compensating transistor, the isolating transistor, and the resetting transistor so as to reset the storage capacitor;

S1, applying a scan signal at the first scan signal terminal and applying a control signal at the first control signal terminal to turn on the first switching transistor and the compensating transistor, and applying a control signal at the second control signal terminal to turn off the isolating transistor, so as to write the threshold voltage of the driving transistor and the data voltage on the data line to the storage capacitor; and S2, applying a scan signal at the first scan signal terminal and applying a control signal at the first control signal terminal to turn off the first switching transistor and the compensating transistor, and applying a control signal at the second control signal terminal to turn on the isolating transistor, so as to drive the OLED to emit light using the voltage stored in the storage capacitor.

9. The driving method of claim 8, wherein the pixel circuit is further connected to a touch circuit, wherein the touch circuit comprises a charging transistor, a coupling capacitor, a sensing electrode, an amplifying transistor and a second switching transistor, a second scan signal terminal and a sensing line;

wherein a gate of the charging transistor is connected to a third control signal terminal, a source thereof is connected to the second terminal of the storage capacitor, a drain thereof is connected to the sensing electrode; a first terminal of the coupling capacitor is connected to the sensing electrode, and a second terminal thereof is connected to the second scan signal terminal; a gate of the amplifying transistor is connected to the sensing electrode, a source thereof is connected to the power supply terminal, a drain thereof is connected to the source of the second switching transistor; and a gate of the second switching transistor is connected to the second scan signal terminal, and a drain thereof is connected to the sensing line, characterized in that, the step S1 further comprises: applying a scan signal at the first scan signal terminal to turn on the charging transistor, and applying a scan signal at the second scan signal terminal to turn off the second switching transistor, so as to charge the coupling capacitor by the power supply terminal via the driving transistor and the charging transistor; and the step S2 further comprises: applying a scan signal at the first scan signal terminal to turn off the charging transistor, applying a scan signal at the second scan signal terminal to turn on the second switching transistor, and monitoring a variation of a current on the sensing line.

10. The driving method of claim 8, wherein the pixel circuit is further connected to a touch circuit, wherein the touch circuit comprises a charging transistor, a coupling capacitor, a sensing electrode, an amplifying transistor and a second switching transistor, a second scan signal terminal and a sensing line;

wherein a gate of the charging transistor is connected to a third control signal terminal, a source thereof is connected to the second terminal of the storage capacitor, a drain thereof is connected to the sensing electrode; a first terminal of the coupling capacitor is connected to the sensing electrode, and a second terminal thereof is connected to the second scan signal terminal; a gate of the amplifying transistor is connected to the sensing electrode, a source thereof is connected to the power supply terminal, a drain thereof is connected to the source of the second switching transistor; and a gate of the second switching transistor is connected to the second scan signal terminal, and a drain thereof is connected to the sensing line, characterized in that, the step S1 further comprises: applying a scan signal at the first scan signal terminal to turn on the charging transistor, and applying a scan signal at the second scan signal terminal to turn off the second switching transistor, so as to charge the coupling capacitor by the power supply terminal via the driving transistor and the charging transistor; and the step S2 further comprises: applying a scan signal at the first scan signal terminal to turn off the charging transistor, applying a scan signal at the second scan signal terminal to turn on the second switching transistor, and monitoring a variation of a current on the sensing line.

11. A display device comprising a plurality of pixel circuits, each of the pixel circuits comprising an electroluminescent element, a driving transistor, a first switching circuit, a compensating circuit, an isolating circuit, a storage capacitor and a resetting transistor, wherein the first switching circuit controls input of a data voltage on a data line under control of a first scan signal terminal, and a control terminal of the first switching circuit is connected to the first can signal terminal, a first terminal of the first switching circuit is connected to a first terminal of the storage capacitor, a second terminal of the first switching circuit is connected to the data line;

a second terminal of the storage capacitor is connected to a gate of the driving transistor and a first terminal of the compensating circuit;

the compensating circuit controls the storage capacitor to pre-store a threshold voltage of the driving transistor under control of a first control signal terminal, a control terminal of the compensating circuit is connected to the first control signal terminal, and a second terminal of the compensating circuit is connected to a drain of the driving transistor;

a source of the driving transistor is connected to a power supply terminal, the drain of the driving transistor is connected to a first terminal of the electroluminescent element;

the isolating circuit isolates an electrical connection between the electroluminescent element and a grounded terminal under control of a second control signal terminal, wherein a control terminal of the isolating circuit is connected to the second control signal terminal, a first terminal of the isolating circuit is connected to a second terminal of the electroluminescent element, and a second terminal of the isolating circuit is connected to the grounded terminal; and a gate of the resetting transistor is connected to the first terminal of the isolating circuit, a source of the resetting transistor is connected to the first terminal of the storage capacitor, and a drain thereof is connected to the second control signal terminal.

12. The display device of claim 11, characterized in that the electroluminescent element is an Organic Light Emitting Diode, the first switching circuit is a first switching transistor, the compensating circuit is a compensating transistor, and the isolating circuit is an isolating transistor;

a gate of the first switching transistor is connected to the first scan signal terminal, a source thereof is connected to the first terminal of the storage capacitor, a drain thereof is connected to the data line;

the second terminal of the storage capacitor is connected to the gate of the driving transistor and a drain of the compensating transistor;

a gate of the compensating transistor is connected to the first control signal terminal, a source thereof is connected to the drain of the driving transistor;

the source of the driving transistor is connected to the power supply terminal, the drain of the driving transistor is connected to an anode of the OLED; and a gate of the isolating transistor is connected to the second control signal terminal, a source thereof is connected to a cathode of the OLED, and a drain thereof is connected to the grounded terminal.

13. The display device of claim 12, characterized in that the pixel circuit is further connected to a touch circuit, wherein the touch circuit comprises a charging transistor, a coupling capacitor, a sensing electrode, an amplifying transistor and a second switching transistor, a second scan signal terminal and a sensing line;

wherein a gate of the charging transistor is connected to a third control signal terminal, a source thereof is connected to the second terminal of the storage capacitor, a drain thereof is connected to the sensing electrode;

a first terminal of the coupling capacitor is connected to the sensing electrode, and a second terminal thereof is connected to the second scan signal terminal;

a gate of the amplifying transistor is connected to the sensing electrode, a source thereof is connected to the power supply terminal, a drain thereof is connected to the source of the second switching transistor; and a gate of the second switching transistor is connected to the second scan signal terminal, and a drain thereof is connected to the sensing line.

14. The display device of claim 12, characterized in that the pixel circuit is further connected to a touch circuit, wherein the touch circuit comprises a charging transistor, a coupling capacitor, a sensing electrode, an amplifying transistor and a second switching transistor, a second scan signal terminal and a sensing line;

wherein a gate of the charging transistor is connected to a third control signal terminal, a source thereof is connected to the second terminal of the storage capacitor, a drain thereof is connected to the sensing electrode;

a first terminal of the coupling capacitor is connected to the sensing electrode, and a second terminal thereof is connected to the second scan signal terminal;

a gate of the amplifying transistor is connected to the sensing electrode, a source thereof is connected to the power supply terminal, a drain thereof is connected to the source of the second switching transistor; and a gate of the second switching transistor is connected to the second scan signal terminal, and a drain thereof is connected to the sensing line.

15. The display device of claim 13, characterized in that the third control signal terminal is the first scan signal terminal.

16. The display device of claim 14, characterized in that the third control signal terminal is the first scan signal terminal.

17. The display device of claim 12, characterized in that all the transistors have a same type of channel.

* * * * *